US008028862B2

(12) United States Patent
Rossignol

(10) Patent No.: US 8,028,862 B2
(45) Date of Patent: Oct. 4, 2011

(54) PUMP FOR DISPENSING A LIQUID CONTAINED IN A BOTTLE

(75) Inventor: Eric Rossignol, Chalon sur Saone (FR)

(73) Assignee: Rexam Dispensing SMT S.A. (FR)

( * ) Notice: Subject to any disclaimer, the term of this patent is extended or adjusted under 35 U.S.C. 154(b) by 350 days.

(21) Appl. No.: 12/256,188

(22) Filed: Oct. 22, 2008

(65) Prior Publication Data

US 2009/0101677 A1 Apr. 23, 2009

(30) Foreign Application Priority Data

Oct. 23, 2007 (FR) ..... 07 07430

(51) Int. Cl.

| | |
|---|---|
| ***G01F 11/00*** | (2006.01) |
| ***B67D 7/58*** | (2010.01) |
| ***B65D 88/54*** | (2006.01) |
| ***B65D 83/00*** | (2006.01) |
| ***B05B 7/30*** | (2006.01) |

(52) U.S. Cl. ..... 222/256; 222/380; 222/321.7; 222/402.13; 239/354

(58) Field of Classification Search ..... 222/256, 222/321.3, 321.7, 321.8, 321.9, 380, 402.1, 222/402.13, 402.12, 402.15, 387, 518; 239/354
See application file for complete search history.

(56) References Cited

U.S. PATENT DOCUMENTS

| | | | | |
|---|---|---|---|---|
| 4,174,056 | A * | 11/1979 | Loeffler | 222/321.8 |
| 5,429,275 | A * | 7/1995 | Katz | 222/108 |
| 5,779,106 | A * | 7/1998 | Albini et al. | 222/321.3 |
| 6,824,021 | B2 * | 11/2004 | Masuzzo et al. | 222/321.7 |
| 6,966,465 | B2 * | 11/2005 | Kang | 222/321.9 |
| 7,048,155 | B2 * | 5/2006 | Kuwahara et al. | 222/321.9 |
| 7,503,466 | B2 * | 3/2009 | Ramet | 222/321.9 |
| 2003/0164385 | A1 * | 9/2003 | Masuzzo et al. | 222/321.7 |
| 2006/0255072 | A1 * | 11/2006 | Hagin et al. | 222/321.7 |

FOREIGN PATENT DOCUMENTS

| | | | |
|---|---|---|---|
| FR | 02893314 | A1 | 5/2007 |
| WO | 03084573 | A1 | 10/2003 |

OTHER PUBLICATIONS

French Search Report, Jun. 23, 2008 (6 pages).

* cited by examiner

*Primary Examiner* — Kevin P Shaver
*Assistant Examiner* — Stephanie E Williams
(74) *Attorney, Agent, or Firm* — St. Onge Steward Johnston & Reens LLC

(57) ABSTRACT

A pump intended to be mounted on a bottle, so as to allow the dispensing of a liquid contained in the bottle, includes a needle for closing an ejection orifice that is separate from a dosing sleeve. The needle is mounted on the sleeve by a device for the reversible movement of the needle between a closure position and an ejection position, the device being actuated by interference between the sleeve and a piston when a push button is moved on a hoop.

14 Claims, 3 Drawing Sheets

PUMP FOR DISPENSING A LIQUID CONTAINED IN A BOTTLE

CROSS-REFERENCE TO RELATED APPLICATIONS

The present application claims priority of French patent application FR 07 07430 filed on Oct. 23, 2007, the content of which is incorporated herein by reference.

FIELD OF THE INVENTION

The invention concerns a pump intended to be mounted on a bottle so as to allow the dispensing of a liquid contained in said bottle, and a bottle containing a liquid product on which such a pump is mounted.

BACKGROUND OF THE INVENTION

In a particular application, the liquid is of the gel or cream type, for example for use in cosmetics or for pharmaceutical treatments.

Pumps having the following properties are known:

- sealed closure of the ejection orifice in order to limit contact between the external air and the liquid stationary in the pump, in particular to prevent drying and/or degradation of said liquid over time;
- absence of contact between the liquid and metallic parts in order to prevent any physical and chemical degradation of the liquid;
- absence of passage for taking up air in the bottle in compensation for the product rendered.

SUMMARY OF THE INVENTION

The invention aims to simplify the production of such pumps by proposing a design consisting of parts that are simple to produce and limited in number.

In addition, the pump according to the invention proposes impermeability of the closure that is improved so as to be able to dispense liquids whose sensitivity to air is significant. Consequently the combined use of a pump according to the invention with a bottle containing a liquid sensitive to air is particularly advantageous.

In particular, sensitivity to air means liquids containing a solvent liable to evaporate rapidly, for example based on alcohol or water, or containing photosensitive substance, for example sunblocks, or ones that are easily oxidisable, for example vitamins, in particular vitamin C.

Moreover, the functioning of the pump according to the invention limits the pressurisation of the liquid during dispensing. Thus the combined use of a pump according to the invention with a bottle containing a liquid sensitive to mechanical forces is also particularly advantageous.

In particular, sensitive to mechanical forces means liquids, for example creams, liable to undergo physical and chemical transformation under pressure, in particular a separation or phase change.

In addition, the pump proposed by the invention is particularly compact so as to be able to be used in combination with small-diameter bottles, for example between 30 and 45 mm, with a content of between 30 and 50 ml and a dose volume of between 300 and 500 μl.

The functioning of the pump according to the invention also allows the dispensing of particularly viscous liquids.

To achieve these various improvements to pumps according to the prior art, according to a first aspect the invention proposes a pump intended to be mounted on a bottle so as to allow the dispensing of a liquid contained in said bottle, said pump comprising:

- a hoop intended to be connected to the bottle, said hoop comprising an orifice for putting in communication with the liquid;
- a push button comprising an ejection orifice for the liquid, said push button being mounted on said hoop in translation restrained by an elastic return means;
- a dosing sleeve mounted in said push button and a dosing piston mounted in said hoop, said dosing piston comprising a dispensing channel for the liquid, said channel being equipped with a valve for the reversible closure of the orifice for putting in communication, said sleeve and said piston defining between them a dosing chamber for the liquid and being mounted in sealed translation with respect to each other on a liquid dispensing/suction travel;
- said pump also comprising a needle for closing off the injection orifice that is separate from the dosing sleeve, said needle being mounted on said sleeve by means of a device for the reversible movement of said needle between a closure and an ejection position, said device being actuated by interference between the sleeve and the piston during the movement of the push button on the hoop.

According to a second aspect, the invention proposes a bottle containing a liquid product, said bottle comprising a neck on which the hoop of such a pump is mounted with the orifice in communication with the liquid.

BRIEF DESCRIPTION OF THE DRAWINGS

Other objects and advantages of the invention will emerge in the following description given with reference to the accompanying figures, in which.

DETAILED DESCRIPTION OF THE INVENTION

Figure 1B:
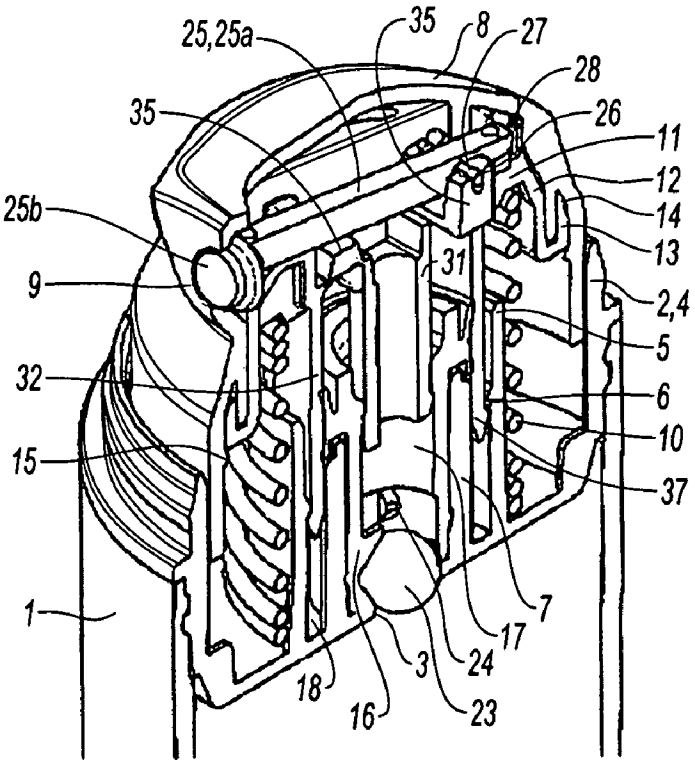
FIGS. 1*a* and 1*b* are partial views of a bottle equipped with a pump in the idle position according to one embodiment of the invention, respectively in longitudinal section (FIG. 1*a*) and in cut-away perspective (FIG. 1*b*)

In the description, the terms relating to positioning in space are taken with reference to the position of the pump shown in the figures.

In relation to the figures, a description is given of an embodiment of a pump mounted on a bottle so as to allow the dispensing of a liquid contained in said bottle. In one example of application, the liquid is a gel or a cream, for cosmetic use or for pharmaceutical treatments.

The bottle comprises a body surmounted by a neck 1 on which the pump is mounted. In addition, a follower piston (not shown) for the liquid is mounted slideably in the body so as to bring the liquid into said pump with a view to its dispensing without the takeup of air. To do this, the bottle comprises, opposite to the pump, a vent hole. Although the description is made in relation to dispensing without the takeup of air, the pump according to the invention can be used with other types of dispensing.

The pump comprises a hoop 2 fixed in the neck 1 of the bottle, said hoop comprising an orifice 3 for putting the pump in communication with the liquid contained in the body. More precisely, the hoop 2 is mounted sealingly on the neck 1 with the orifice 3 in communication with the liquid.

The hoop 2 can be produced by moulding a plastics material, in particular polypropylene, and comprises a bottom in which the orifice 3 is formed axially. Moreover, the hoop 2 has a geometry cylindrical of revolution and, from the bottom, extending concentrically:

- an external sleeve 4, part of the external surface of which is fitted in the neck 1;
- an internal sleeve 5, the bottom end of which is provided with a stop 6; and
- a central sleeve 7, on the bottom wall of which the dispensing orifice 3 is formed.

Moreover, the bottle can comprise a cap intended to be mounted on the outside of the external sleeve 4, above the part fitted in the neck 1.

The pump comprises a push button 8 that is provided with an orifice 9 for ejecting the liquid, said push button being mounted on the hoop 2 in translation restrained by an elastic return spring formed by a spring 10. More precisely, the push button 8 comprises a skirt provided with the orifice 9 for a substantially radial ejection.

The pump also comprises a dosing sleeve 11 that is mounted in the push button 8 in order to be moved by it over the translation travel. The sleeve 11 is surrounded by an external skirt 12 that comprises an annular rim 13 cooperating with a groove 14 formed in the skirt of the push button 8, so as to form a sealed association zone between said sleeve and said push button. In addition, the association is made reliable by the formation of a projection 15 formed in the skirt of the push button 8 in order to keep said rim in position in said groove.

Moreover, the radial connecting wall between the skirt 12 and the sleeve 11 forms a stop surface for the spring 10, said spring also being disposed around the internal sleeve 5 of the hoop 2.

The pump also comprises a dosing piston 16 that comprises a dispensing channel 17 for the liquid, said channel being equipped with a closure valve for the orifice 3. The dosing piston 16 has a geometry cylindrical of revolution and can be produced by moulding a plastics material.

The piston 16 and the sleeve 11 define between them a dosing chamber for the liquid and are mounted in sealed translation with respect to each other on a travel for dispensing/sucking the liquid. To do this, the dosing sleeve 11 is mounted in sealed sliding in a space 18 formed between the internal 5 and central 7 sleeves.

More precisely, the dosing sleeve 11 is in rubbing contact on sealing means formed on the piston 16, said means comprising a top lip 19 and a bottom lip 20 that are formed in the vicinity of the top end of the piston 16. This design makes it possible to improve the seal, in particular by providing that a lip 19, 20 be pressed on the sleeve 11 in each of the translation directions.

In the embodiment shown, the dosing piston 16 is fixed by fitting in the central sleeve 7, the said fitting being made reliable by the cooperation of a groove 21 and a projection 22 provided respectively on the sleeve 7 and in the piston 16. In this embodiment where the piston 16 is fixed, the valve comprises a ball 23 that is mounted on a seat formed on the orifice 3 for putting in communication, said seat being provided with claws 24 for limiting the upward movement of said ball. In particular, the use of a ball 23 makes it possible to achieve a suction power for the liquid that is high, in particular in that it is possible to add together the suctions since the air is not reintroduced into the bottle. Thus it is possible to dispense liquids having high viscosity.

The pump also comprises a needle 25 for closing off the ejection orifice 9 which, in the embodiment depicted, has an arm 25*a*, the front end of which is provided with a closure head 25*b* that comes to be engaged sealingly in the ejection orifice 9.

The needle 25 is separate from the dosing sleeve 11, that is to say said needle and said sleeve are produced in two distinct parts, in particular by moulding. Apart from the simplification of the production of the parts, the needle 25 can thus be produced from more ductile material that the one forming the push button 8, in particular from polyethylene compared with polypropylene, so as to allow better conformation of the head 25*b* in the orifice 9.

Moreover, the movement of the needle 25 can then be optimised in relation to its function of sealing the orifice 9. In particular, as shown in the figure, the translation of the needle 25 is achieved along the axis of the orifice 9 so as to make reliable the centring of the head 25*b* in said orifice and to improve the pressing of said head in said orifice.

In the embodiment depicted, the rear end of the arm 25*a* is mounted on the dosing sleeve 11 by means of a fork 26 in which a spindle 27 formed laterally on each side of said needle is engaged. In addition, the needle 25 is mounted on the dosing sleeve 11 by means of a device for the reversible movement of said needle between a closure position and an injection position, said device being actuated by interference between the sleeve 11 and the piston 16 during the movement of the push button 8 on the hoop 2.

The needle 25 is disposed in the sealed volume formed in the top part of the push button 8, and more precisely under the top wall of said push button. In addition, the push button 8 comprises surfaces for guiding the translation of the needle 25 and a stop 28 for said needle in the ejection position. In the figures, the button has a front guide surface 29 formed in the vicinity of the orifice 9 and a rear guide surface 30 that is extended by the stop 28 in order to form a housing for the rear end of the needle 25.

In the embodiment described, the dosing sleeve 11 comprises a hollow tube 31 that is integrated in a body of the sleeve 32 by means of the movement device, said body being mounted in translation in the space 18. Moreover, the tube 31 is slideably mounted in the dosing piston 16 with sufficient interference to actuate said device before or at the start of the translation over the dispensing/suction travel. To do this, the periphery of the tube 31 is provided with a sliding ring 33 in the channel, said ring cooperating with a stop 34 provided in the piston 16 so as to define the top end-of-travel of the ring 33 inside the channel 17.

According to one embodiment, the movement device comprises at least one link 35 that is arranged so as to allow a reversible movement of the body 32 of the dosing sleeve 11 with respect to the tube 31, said device also being arranged to convert said translation movements of the needle 25 relative to said push button into a respectively ejection and closure position. In addition, the link 35 is provided with means of mounting the rod, that is to say the fork 26 in the figures.

In the embodiment depicted, the tube 31 is integrated in the body 32 of the dosing sleeve 11 by means of two links 35 each having an internal articulation 35*a* and an external articulation 35*b* with respectively the tube 31 and the body 32. In the figures, the articulations are produced by thinning of material.

In addition, the links 35 are disposed, on each side of the tube 31, along the plane containing the translation direction of the needle 25, and the rear end of the arm 25*a* is mounted on the rear link 35. In addition, the rear link 35 has an inclined top surface that is formed between the jaws of the fork 26 so as to come to interfere with the needle 25 in the ejection position.

This surface, possible in combination with the stop 28 formed in the button 8, makes it possible in particular to mechanically hold the needle 25 when it is in the ejection position so as to limit the constraints undergone by the movement device over the dispensing travel.

Figure 3:
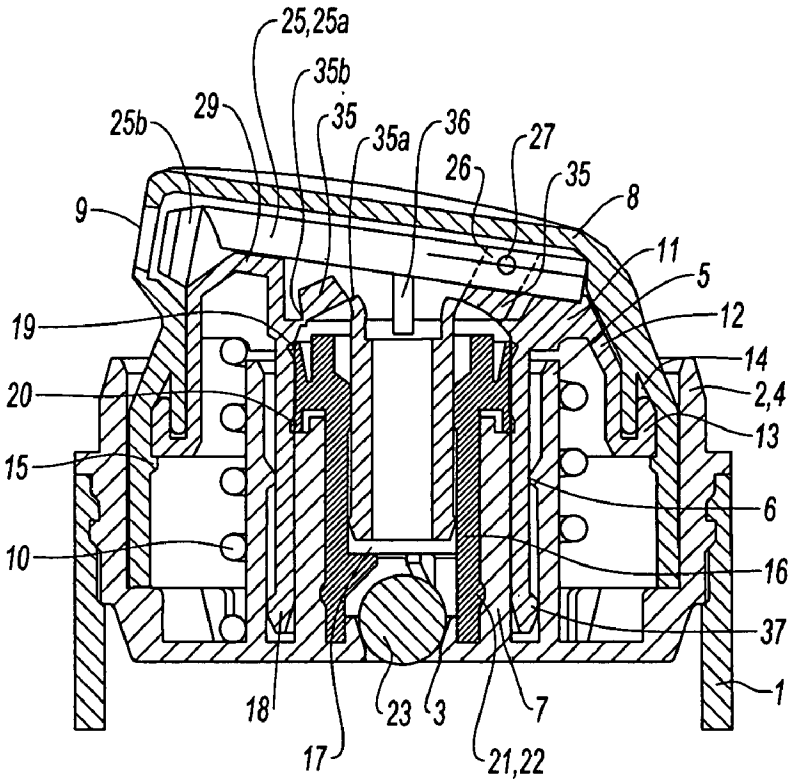
FIGS. 2 to 5 are partial views in longitudinal section of the bottle according to FIG. 1 in the following various positions of use: in the open position of the orifice (FIG. 2), at the end of the dispensing travel (FIG. 3), in the closed position of the orifice (FIG. 4) and in the suction travel (FIG. 5).
Figure 2:
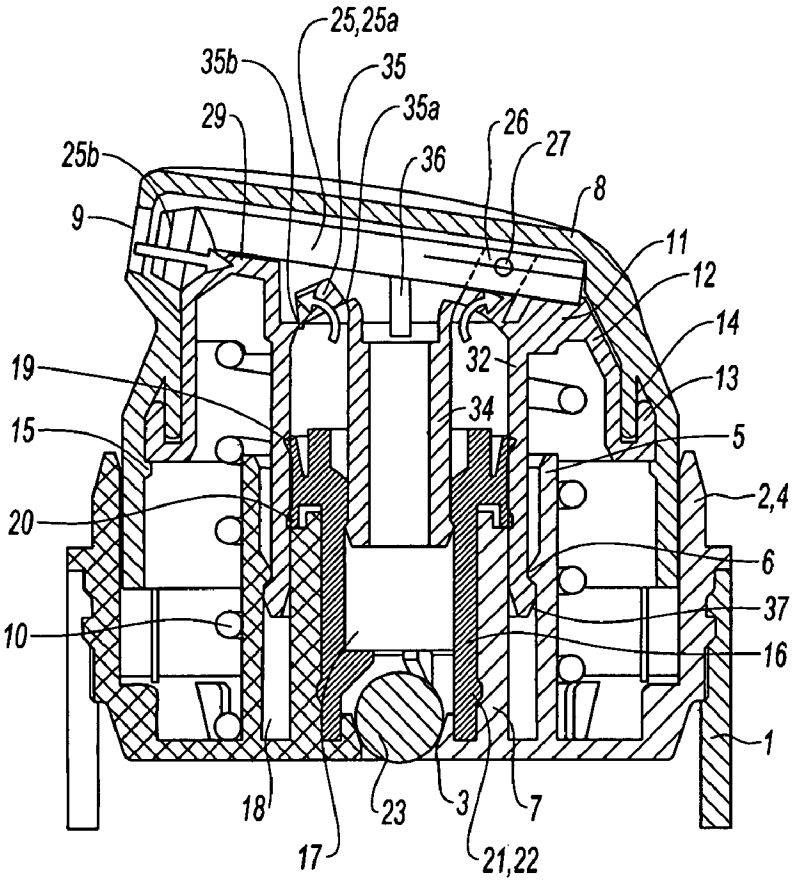

In addition, a stop 36 is formed to limit the upward movement of the tube 31 with respect to the body 32, said stop being formed in the push button 8 in order to come into abutment on said tube at the end of downward movement of the body 32 (FIGS. 2 and 3).

Figure 1A:
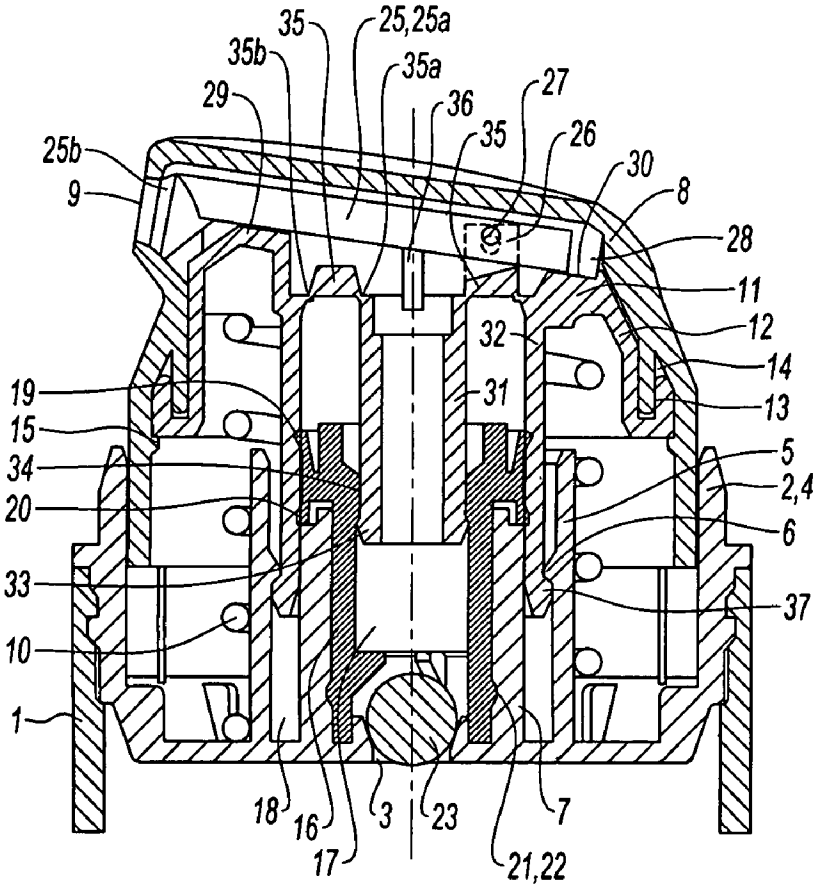

In relation to the figures, the functioning of the pump described above is described. In the idle position (FIG. 1), the ball 23 is on its seat and the needle 25 is in the closure position. In addition, the stop 34 provided in the dispensing channel is disposed so as, under the effect of the return spring 10, to force the tube 31 downwards in order, by means of the movement device, to push the head 25*b* into the ejection orifice 9. In this way a good seal is obtained at the closure of the ejection orifice 9. In addition, a ring 37 formed on the bottom part of the body 32 is in abutment on the stop 6 of the internal sleeve 5 in order to delimit the end of travel of the push button 8 in the hoop 2.

By pressing on the push button 8 (FIG. 2), before or at the start of the dispensing travel, the needle 25 is moved into the ejection position by movement of the body 32 with respect to the tube 31. To do this, the force necessary for moving the ring 33 in the channel 17 is arranged so as to be greater than that necessary for making the links 35 pivot in the direction of the arrows shown. Thus, by pivoting, the rear link 35 pulls on the spindle 27 of the needle 25 so as to move it axially. It will be noted that the opening of the ejection orifice 9 was achieved substantially without pressurising the liquid, only by mechanical interaction between the parts of the pump.

In the dispensing travel and up to its end (FIG. 3), the needle 25 is in abutment in its ejection position and the clamping force of the ring 33 in the dosing piston 16 is overcome so that a movement of the body 32 causes that of the tube 31 in said channel, so as to allow a reduction in the volume of the dosing chamber. Thus, the ball 23 being pressed on its seat, the liquid flows by means of the orifice 9 and, during the dispensing of the liquid, the pressurisation of the liquid is also very limited.

Figure 5:
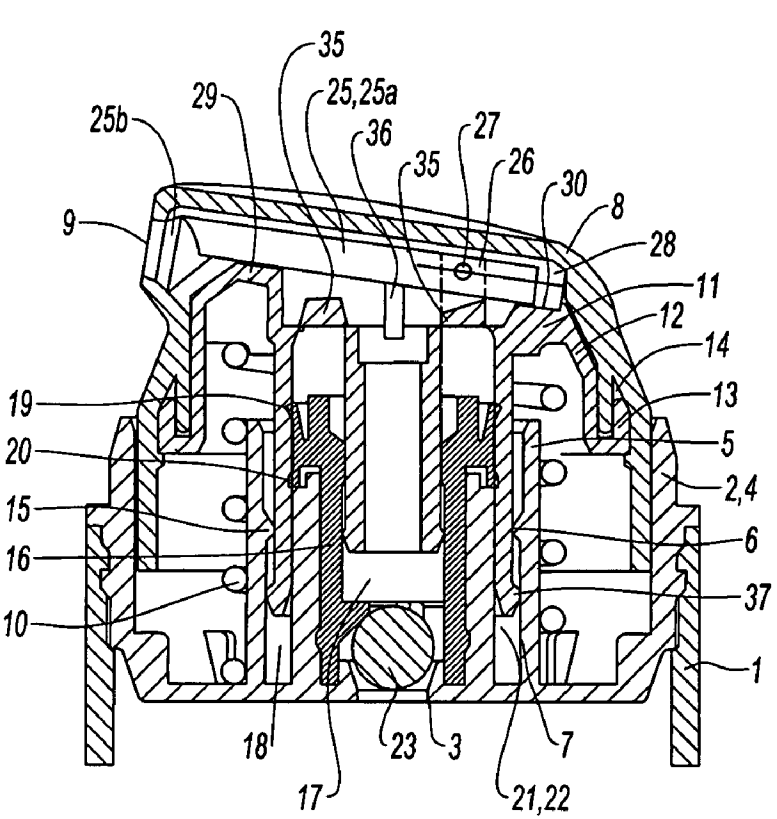
Figure 4:
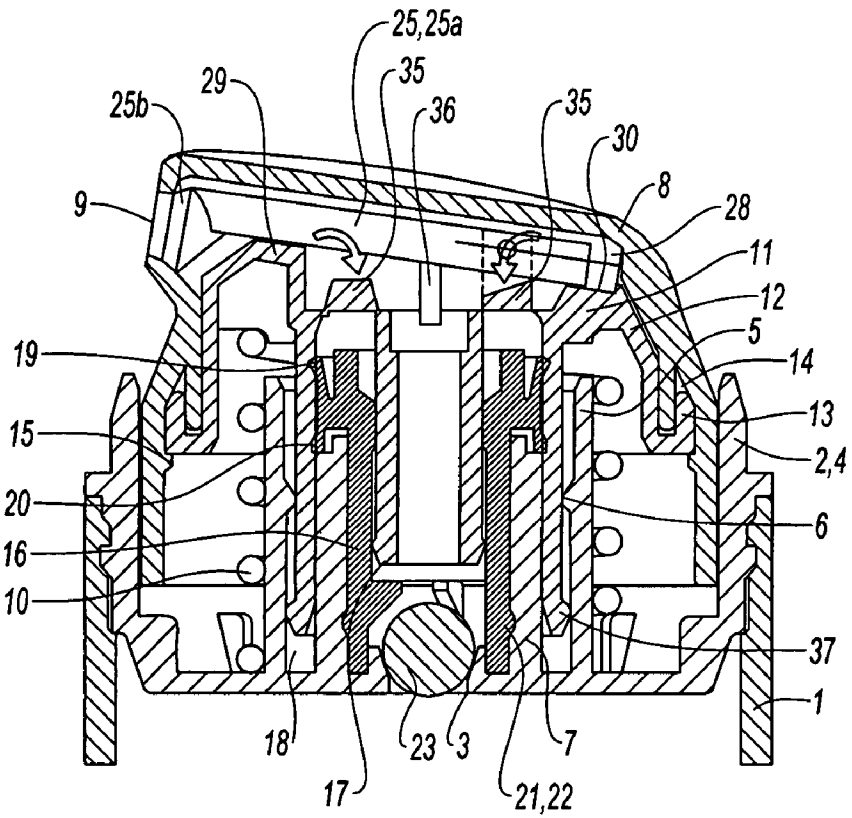

In FIG. 4, the pressing on the push button 8 is released so that the spring 10 exerts an upward force on it. This force causes, by pivoting of the links 35 in the direction of the arrows shown, an upward movement of the body 32 with respect to the tube 31, so as to move the needle 25 into the closure position in which the head 25*b* is pressed sealingly in the orifice 9. Next the negative pressure formed by an increase in the volume of the dosing chamber lifts the ball 23 from its seat so as, over the suction travel (FIG. 5) corresponding to the return into the idle position of the push button 8 under the force of the spring 10, to supply said chamber with the next dose of liquid to be dispensed.

What is claimed is:

1. A pump adapted to be mounted on a bottle so as to allow the dispensing of a liquid contained in said bottle, said pump comprising:

a hoop adapted to be fixed to the bottle, said hoop comprising an orifice adapted to be in communication with the liquid;

a push button comprising an orifice adapted to eject the liquid, said push button being mounted on said hoop in translation restrained by an elastic return element;

a dosing sleeve mounted in said push button and a dosing piston mounted in said hoop, said dosing piston comprising a channel adapted to dispense the liquid, said channel being equipped with a valve for reversible closure of the orifice, said sleeve and said piston defining between them a chamber adapted to dose the liquid and being mounted in sealed translation with respect to each other on a liquid dispensing/suction travel;

said pump further comprising a needle for closing the ejection orifice which is separate from the dosing sleeve, said needle being mounted on said sleeve by means of a device for the reversible movement of said needle between a closure position and an ejection position, said device being actuated by interference between the sleeve and the piston when the push button is moved on the hoop; and wherein the dosing sleeve comprises a tube integrated in a body of the sleeve by means of the movement device, said tube being mounted slideably in the dosing piston with sufficient interference to actuate said device before or at the start of the translation over the dispensing/suction travel.

2. The pump according to claim 1, wherein the movement device comprises at least one link that is arranged to allow a reversible movement of the body of the sleeve with respect to the tube, said device also being arranged to convert the movements into translation of the needle relative to said push button in a position respectively of ejection and closure, said link being provided with a needle mounting mechanism.

3. The pump according to claim 2, wherein the link has an internal articulation and an external articulation with respectively the tube and the body of the sleeve.

4. The pump according to claim 3, wherein the tube is integrated in the body of the sleeve by means of two links that are disposed, on each side of said tube, along a plane containing a translation direction of the needle.

5. The pump according to claim 4, wherein the needle comprises an arm, a front end of which is provided with a closure head, and a rear end of said arm being mounted on a rear link.

6. The pump according to claim 1, wherein the needle is mounted in the push button, the said button comprising surfaces for guiding translation of the needle and a stop for said needle in the ejection position.

7. The pump according to claim 2, wherein a stop is formed to limit upward movement of the tube with respect to the body of the sleeve.

8. The pump according to claim 7, wherein the stop is formed in the push button in order to come into abutment on the tube at an end of downward movement of the body of the sleeve.

9. The pump according to claim 2, wherein the needle mounting mechanism comprises a fork in which a spindle formed on said needle is engaged.

10. The pump according to claim 1, wherein the hoop comprises a central sleeve in which the dosing piston is fixed, a bottom wall of the sleeve being provided with the orifice adapted to be in communication with the liquid.

11. The pump according to claim 10, wherein the hoop comprises an internal sleeve surrounding the central sleeve, forming a space in which the dosing sleeve is mounted for sealed sliding.

12. The pump according to claim 11, wherein the dosing sleeve is in rubbing contact on seals formed on the piston.

13. The pump according to claim 1, wherein the valve comprises a ball mounted on a seat formed on the orifice adapted to be in communication with the liquid.

14. A bottle containing a liquid product, said bottle comprising a neck on which the hoop of a pump according to claim 1 is mounted with the orifice in communication with the liquid.

* * * * *